US007180416B1

(12) United States Patent
Amidon

(10) Patent No.: US 7,180,416 B1
(45) Date of Patent: Feb. 20, 2007

(54) TIME KEYED INFORMATION TRANSMISSION

(75) Inventor: Charles Philip Amidon, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 216 days.

(21) Appl. No.: 11/076,831

(22) Filed: Mar. 2, 2005

(51) Int. Cl.
*G08B 1/08* (2006.01)

(52) U.S. Cl. ..... 340/539.22; 340/545.2; 340/870.16; 340/870.17; 340/447; 340/449; 340/451; 340/584; 340/665

(58) Field of Classification Search ..... 340/539.22, 340/545.2, 870.16, 870.17, 447, 449, 451, 340/584, 665
See application file for complete search history.

(56) References Cited

U.S. PATENT DOCUMENTS 4,374,382 A 2/1983 Markowitz
4,848,923 A 7/1989 Ziegler et al.
5,822,369 A 10/1998 Araki
6,278,379 B1 8/2001 Allen et al.
6,670,887 B2 * 12/2003 Dungan ..... 340/632
6,717,529 B1 4/2004 Belvin et al.
6,717,530 B1 4/2004 Schmidt et al.
6,985,831 B2 * 1/2006 Ito et al. ..... 702/188

* cited by examiner

*Primary Examiner*—Tai Nguyen
(74) *Attorney, Agent, or Firm*—Jean-Paul A. Nasser; James M. Kasischke; Michael P. Stanley

(57) ABSTRACT

A method and apparatus is described for enabling a single sensor to indicate a greater quantity of information about a sensed event, or the occurrence of many different types of events. A sensor system employs a number of individual sensors with single-use indication means (such as an explosive charge). Each individual sensor is equipped with a chronometer. The sensors are programmed to transmit information through their single-use indication means at specific times with each specific time being indicative of a particular type of event or of specific information about an event. A central monitor chronologically records all sensor indications and compares indication times to a schedule of time keyed information to determine the nature of each sensor indication.

16 Claims, 2 Drawing Sheets

TIME KEYED INFORMATION TRANSMISSION

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER RELATED APPLICATIONS

Not applicable.

BACKGROUND OF THE INVENTION (1) Field of the Invention

The present invention relates to sensors, and more specifically to a method and apparatus of utilizing a single sensor to indicate the occurrence of many different types of events.

(2) Description of the Prior Art

Due to ongoing research, sensors continue to become smaller and less expensive. There are scenarios where it may be useful and practical to distribute many thousands of sensors in an area to perform various detection and monitoring tasks. Creating a sensor system wherein the sensors are capable of sensing their environment is a fairly simple endeavor. In comparison, however, providing a method for the sensors to transmit information to an end user concerning what the sensors have sensed is far more complicated. One technique for a sensor to provide information to an end user concerning an event that has been sensed is to have a sensor detonate a small explosive charge when certain sensing criteria are determined by the sensor, such as sensing the passing of a certain target signature or sensing a certain chemical. Obviously there are limitations to using explosive charges as indication means. An explosive charge is a single use indication means that can only provide a minimum of details about the occurrence of an event. What is needed is a method and apparatus that enables a sensor with a single use indication means to transmit a greater quantity of information about a single event or a series of events.

SUMMARY OF THE INVENTION

It is a general purpose and object of the present invention to establish a sensor system of sensors with single-use indication means (such as an explosive charge) and enable the single-use indication means to transmit either more information about a single event, or to transmit information about more than one sensed event.

This object is accomplished by coupling a highly accurate chronometer to each sensor. The sensors are chronologically synchronized with a monitor, and programmed to indicate an event through a single-use indication means at specific time intervals wherein each specific time interval corresponds to a particular sensed event or to information about a sensed event. The monitor records each indication time and interprets the associated time keyed event according to the time interval of the indication time.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
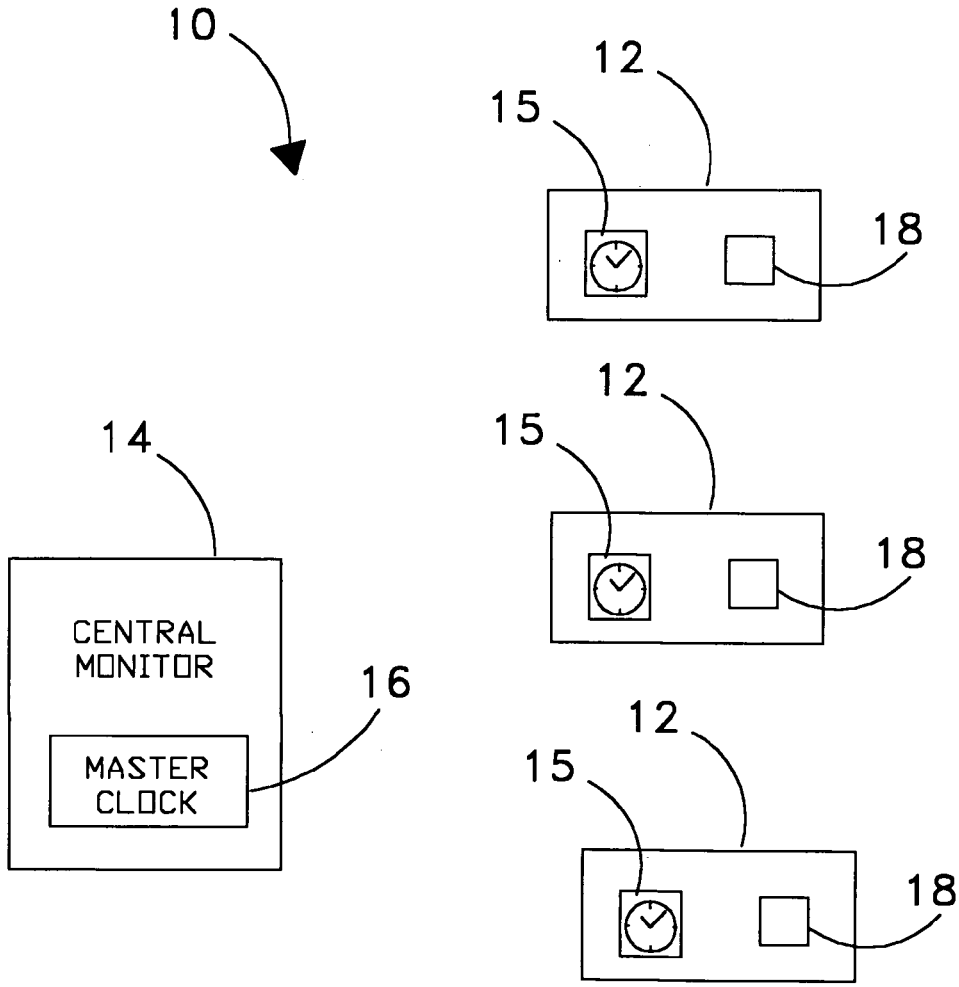
FIG. 1 is a block diagram of the apparatus sensor system.

Referring now to FIG. 1 there is illustrated a block diagram of the apparatus of a sensor system 10 composed of multiple programmable sensors 12 and a central monitor 14. The central monitor 14 is designed with a highly accurate chronometric capability that serves as a master clock 16. Each individual sensor in the sensor system is also designed with a highly accurate chronometric capability 15. All of the sensors in the system are chronometrically synchronized with each other prior to deployment using the master clock 16, or an external reference such as the Global Positioning System as the primary chronometric reference of synchronization. Synchronization of all the sensor chronometers can be accomplished through several means, such as an electronic serial, audio, infrared, or radio frequency connection, between all of the chronometers 15 and the master clock 16.

Each sensor 12 is equipped with a single-use indication means. In the preferred embodiment, a sensor 12 provides an indication by detonating an explosive charge 18, however, indication means are not limited as such. When the sensor 12 senses an event, it will respond with an indication to the monitor (i.e. an explosion). All of the sensor indications are intended to be time specific. The central monitor 14 maintains a chronological record of the indications by the sensors 12.

Figure 2:
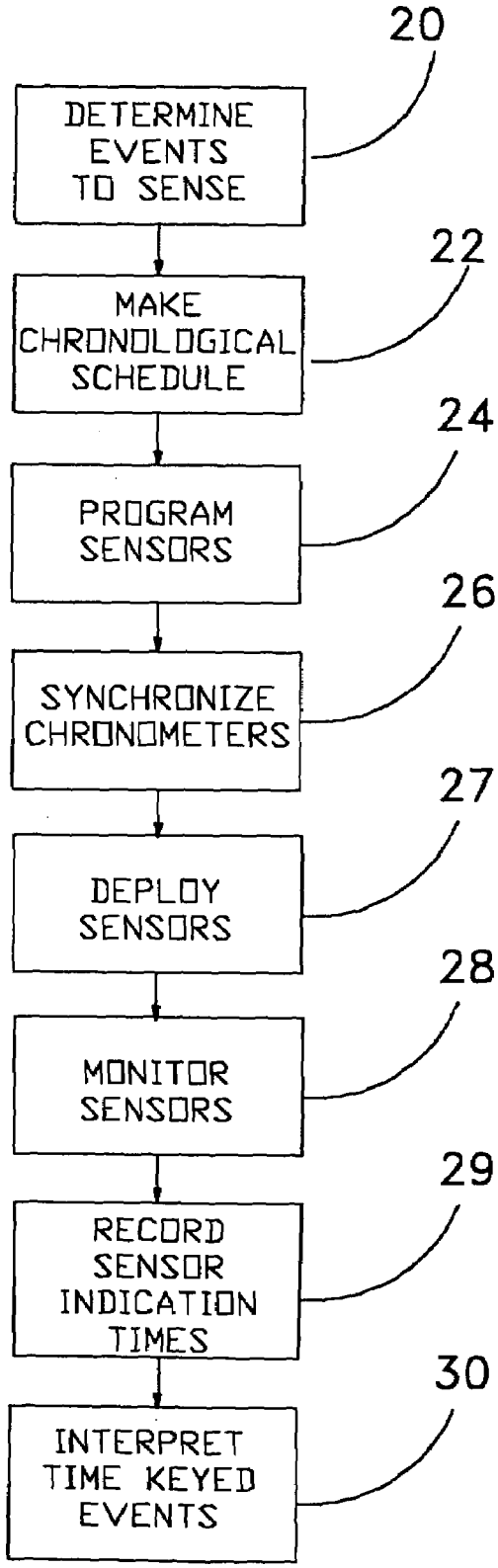
FIG. 2 is a flow chart of the method to transmit sensor information.

Referring now to FIG. 2 there is illustrated a flow chart of the method to transmit sensor information. The first step of the method 20 is to determine which events or phenomena are required to be sensed by the sensors 12. The next step 22 is to make a chronological schedule that corresponds to the occurrence of the required events or phenomenon or to details about a specific event. The chronological schedule assigns the indication of a unique event or phenomenon to specific time increments in a larger time interval. The next step 24 is to program the sensors such that when a particular event or phenomenon is sensed, the sensor indicates the occurrence according to the predetermined chronological schedule. The next step 26 is to synchronize all of the chronometers of the sensors 12 with the master clock 16. The next step is to then deploy the sensors 27. The central monitor then monitors the sensors 28 (i.e. waits for a sensor indication), chronologically records the sensor indications 29 and interprets them 30 as particular events based on the predetermined chronological schedule.

A simple example of this would be to have a chronological schedule that assigns the indication of the detection of either of two chemicals A or B to one of two time slots within an interval of sixty seconds. If chemical A is detected, the indication is to occur within the first time slot of any interval. A sensor 12 would indicate the detection of chemical A by detonating an explosive charge 18 at the commencement of the next sixty-second interval immediately after detecting chemical A. If the sensor 12 detects chemical A at a time 13:04:38, the sensor will wait until 13:05:00 to detonate the explosive charge 18 as an indication. The central monitor 14 records the indication and compares the indication time to the chronological schedule to determine which time keyed event occurred.

Similarly, the chronological schedule could assign the indication of the detection of chemical B to a time slot of thirty seconds after the commencement of each 60-second interval. In this way a sensor 12 would indicate the detection of chemical B by detonating an explosive charge 18 at the commencement of the next thirty-second time slot immediately after detecting chemical B. If the sensor 12 detects chemical B at a time 14:04:12, the sensor 12 will wait until 14:04:30 to detonate the explosive charge 18. If the sensor 12 detects chemical B at a time 14:04:32, the sensor 12 will wait until 14:05:30 to detonate the explosive charge 18.

The sensor 12 in the above example could be programmed to prioritize detection indication after the first detection of either chemical A or B if that suits the purpose of the system 10. In this way if chemical B is detected first at time 14:04:32, but then chemical A is detected at time 14:04:54, the sensor 12 will give priority to the detection of chemical B which was detected first and detonate its explosive charge 18 at 14:05:30. Otherwise the sensor 12 would detonate explosive charge 18 at 14:05:00, thirty seconds earlier, to indicate the detection of chemical A, although chemical A was detected after chemical B.

As a further illustration, a time interval of 60 minutes could be adopted with discrete events time keyed to each one-minute increment. A sensor 12 that is capable of detecting 60 discrete events or phenomena such as chemicals or acoustic target signatures could then provide up to 60 discrete indications by detonating on the appropriate minute within an hour upon detection of one of the 60 discrete events.

Alternatively, rather than detect multiple discrete events, the sensors 12 could detect different aspects of a single event. In that case, the different aspects of the single event could be time keyed allowing the sensor 12 to provide detailed information about a single event. If, for example, the sensors 12 are designed to be deployed in harbors to detect petroleum spills in the water, then details about a spill such as the type of petroleum, the parts per million, or even the temperature of the water at the spill could be time keyed allowing the sensors 12 to provide time specific indications of different aspects of a spill.

The smallest usable increment of time that can be assigned an indication of a unique event or phenomenon is determined by several factors, such as the precision of the synchronization of the chronometers in the system, the accuracy of the system chronometers including the master clock 16 particularly with regard to the drift rate of the sensor chronometers, the service life of the sensors 12, and the travel time of the signal from sensor 12 to monitor 14. Depending upon the above-mentioned factors, it is conceivable that a time increment as small as one second could be assigned an indication of a unique event or phenomenon. Sensors 12 could conceivably detonate on the appropriate second within any minute depending upon the sensing of unique events or phenomena.

The advantages of the present invention over the prior art are that using this method a system can retain the cost savings of employing inexpensive sensors with a single-use detection indicator, while obtaining a greater breadth of events to be detected with the same inexpensive sensor. The only additional cost is the cost associated with combining a highly accurate chronometer with each sensor. This is a fairly small cost in that there exist highly accurate crystal-controlled chronometers or digital electronic chronometers that can be combined with a variety of existing sensors.

Obviously many modifications and variations of the present invention may become apparent in light of the above teachings. For example rather than have a sensor with a single use indicator the system could employ sensors with reusable indicators. In that regard the indicator could generate an acoustic signal created other than by explosive means. The indication of an event could also be a visual indication like a colored dye, or a signal in a predetermined energy frequency spectrum, including radio frequency or visible light.

In light of the above, it is therefore understood that within the scope of the appended claims, the invention may be practiced otherwise than as specifically described.

What is claimed is:

1. A sensor system comprising:

a plurality of programmable sensors wherein each of said plurality of programmable sensors has an event indication means and a chronometer;

a central monitor that monitors said plurality of programmable sensors wherein said central monitor has a master chronometer means for detecting an event indication from any of said plurality of sensors; and a means for synchronizing each chronometer of said plurality of programmable sensors with said master chronometer.

2. A sensor system in accordance with claim 1 wherein each of said plurality of sensors can sense at least one event.

3. A sensor system in accordance with claim 1 wherein said event indication means comprises a single use indication means.

4. A sensor system in accordance with claim 3 wherein said event indication means comprises an explosive charge.

5. A sensor system in accordance with claim 1 wherein said event indication means comprises a reusable indication means.

6. A sensor system in accordance with claim 5 wherein said event indication means comprises an audio signal.

7. A sensor system in accordance with claim 5 wherein said event indication means comprises an electromagnetic signal.

8. A sensor system in accordance with claim 5 wherein said event indication means comprises a colored dye.

9. A sensor system in accordance with claim 1 wherein said central monitor further comprises:

a means for detecting an event indication from any of the said plurality of sensors; and a means for recording a time of said detection of an event indication from said plurality of sensors.

10. A sensor system in accordance with claim 1 wherein said means for synchronizing each chronometer of the said plurality of programmable sensors with said master chronometer comprises electronically connecting all of the said plurality of sensors with the master chronometer.

11. A sensor system comprising:

a plurality of programmable sensors capable of sensing at least one event, wherein each of said plurality of sensors has a chronometer and a single use event indication means comprising an explosive charge;

a central monitor that monitors said plurality of programmable sensors wherein said central monitor has a master chronometer, a means for detecting an event indication from any of said plurality of sensor, and a means for recording a time corresponding to said detection of an event indication from said plurality of sensors; and a plurality of electronic serial connections between all of said plurality of sensors and the master chronometer for synchronizing each chronometer of said plurality of programmable sensors with said master chronometer.

12. An information transmission method for a sensor system having a monitor with a central chronometer and having a plurality of programmable sensors each of which has a chronometer and indication means comprising:

determining which events are required to be sensed;

creating a chronological schedule that corresponds to the occurrence of the determined events;

programming the plurality of programmable sensors such that when a determined event is sensed by a sensor, the sensor indicates the occurrence according to said chronological schedule; and recording a time at which an indication of the occurrence of an event by at least one of said plurality of sensors is made.

13. An information transmission method in accordance with claim 12 further comprising the step of synchronizing all sensor chronometers with the master chronometer after the step of programming the plurality of programmable sensors.

14. An information transmission method in accordance with claim 13 further comprising the step of deploying the plurality of programmable sensors after the step of synchronizing all sensor chronometers with the master chronometer.

15. An information transmission method in accordance with claim 12 further comprising the step of interpreting the indication of the occurrence of an event by comparing the indication time to the chronological schedule after the step of recording a time.

16. An information transmission method in accordance with claim 12 wherein creating a chronological schedule comprises:

choosing a time interval; and assigning an event to a specific time increment within said time interval.

* * * * *